United States Patent [19]

Langan et al.

[11] 4,192,150

[45] Mar. 11, 1980

[54] DEFROSTING ARRANGEMENT FOR A REFRIGERATOR

[75] Inventors: John P. Langan, 599 Springfield Ave., Newark, N.J. 07103; Michael A. DeCicco, S. Bend, Ind.

[73] Assignee: John P. Langan, Orange, N.J.

[21] Appl. No.: 699,340

[22] Filed: Jun. 24, 1976

[51] Int. Cl.[2] ..... F25B 47/00; F25B 41/00

[52] U.S. Cl. ..... 62/277; 62/513

[58] Field of Search ..... 165/30; 62/81, 277, 62/80, 513, 113

[56] References Cited

U.S. PATENT DOCUMENTS

| | | | |
|---|---|---|---|
| 2,693,682 | 11/1954 | Winger et al. | 62/277 |
| 2,759,339 | 8/1956 | Kundert | 62/513 |
| 2,769,311 | 11/1956 | Duncan | 62/277 |
| 2,940,279 | 6/1960 | Schumacher | 62/277 |
| 3,572,051 | 3/1971 | Benasutti | 62/277 |
| 3,984,223 | 10/1976 | Whistler, Jr. | 62/277 |

FOREIGN PATENT DOCUMENTS

| | | | |
|---|---|---|---|
| 522914 | 10/1953 | Belgium | 62/277 |
| 898959 | 6/1962 | United Kingdom | 62/277 |

*Primary Examiner*—Lloyd L. King

[57] ABSTRACT

A heat transfer loop is continuously supplied with hot refrigerant at high pressure from the compressor of a refrigeration system and disposed in contact with evaporator piping to minimize the accumulation of frost thereon.

6 Claims, 3 Drawing Figures

Fig. 2
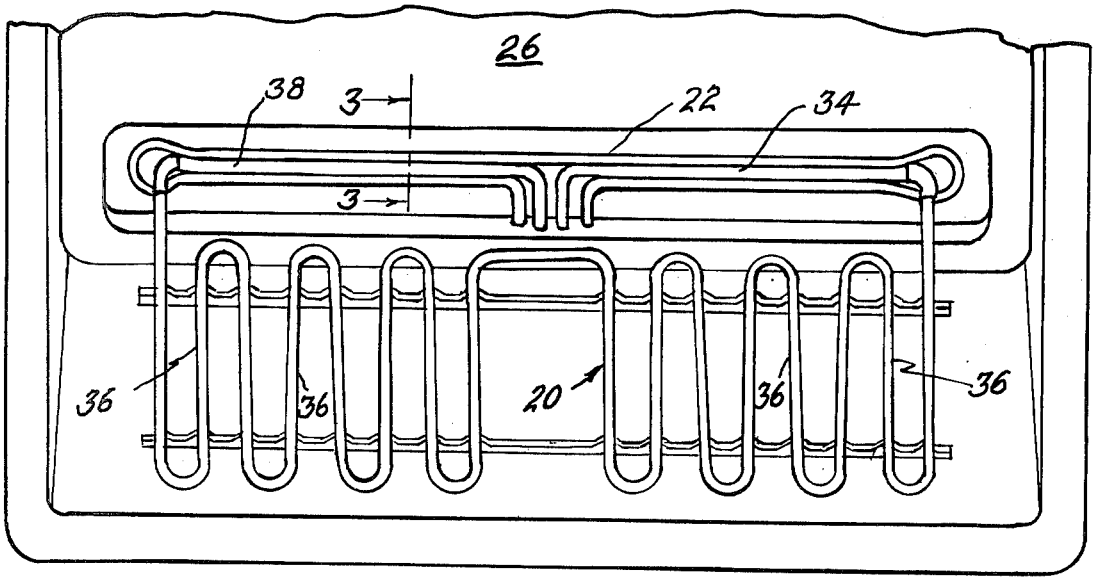
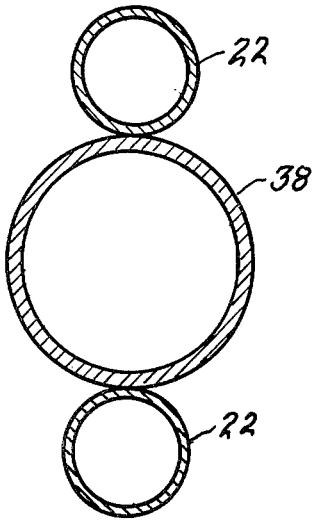
Fig. 3

DEFROSTING ARRANGEMENT FOR A REFRIGERATOR

BACKGROUND OF THE INVENTION

1. Field of the Invention

The invention relates to refrigerator defrosting systems and is particularly directed to a defrosting arrangement continuously effective to minimize the accumulation of frost on evaporator tubing.

2. Description of the Prior Art

It is known to use cyclically operated heaters in refrigerators to remove frost from tubing carrying a refrigerant, but they have not been found entirely satisfactory for the purpose, because of the additional power required for their operation, and because the frost which accumulated between operative periods of the heaters prevented the refrigeration system from operating at optimum efficiency. Furthermore, electrical heating elements which are reliable and not wasteful of electrical energy in the enviornment of a refrigerator have not been generally available. Electrical tape, for example, which was at first thought to be especially suitable as a heating element in a refrigerator, since it could be easily wrapped around a section of tubing on which frost tended to accumulate proved to be unsatisfactory because it would frequently short and burn out, resulting in expensive shut downs and repairs.

It is preferable to use hot refrigerant for defrosting and it is a prime object of this invention to minimize the accumulation of frost in a refrigerator, utilizing hot refrigerant continuously circulated in heat transfer loops of the refrigeration system in a manner such as to effect a reduction in power required to operate the refrigerator.

SUMMARY OF THE INVENTION

In accordance with the invention, high pressure, high temperature refrigerant leaving a compressor is caused to flow continuously through a heat transfer loop which is disposed in contact with evaporator tubing as in the freezer compartment of a refrigerator. Preferably a second heat transfer loop is provided in series with the first loop and deployed at a selected location as around the freezer door. The hot refrigerant flows from the loops to a condenser and after having condensed to a high pressure liquid continues through an expanding device in which the refrigerant is expanded to a low pressure, low temperature liquid. The low temperature liquid circulates through the evaporator where it becomes a low pressure vapor and the low pressure vapor then passes into the suction line of the compressor.

DESCRIPTION OF THE DRAWINGS

FIG. 2 is a pictorial view showing an evaporator in a refrigerator and a heat transfer loop according to the invention in contact with evaporator inlet and discharge tubing; and FIG. 3 is view taken on the plane of the line 3—3 of FIG. 2 showing the said heat transfer loop and contacted tubing in cross-section.

DESCRIPTION OF THE PREFERRED EMBODIMENT

Figure 1:
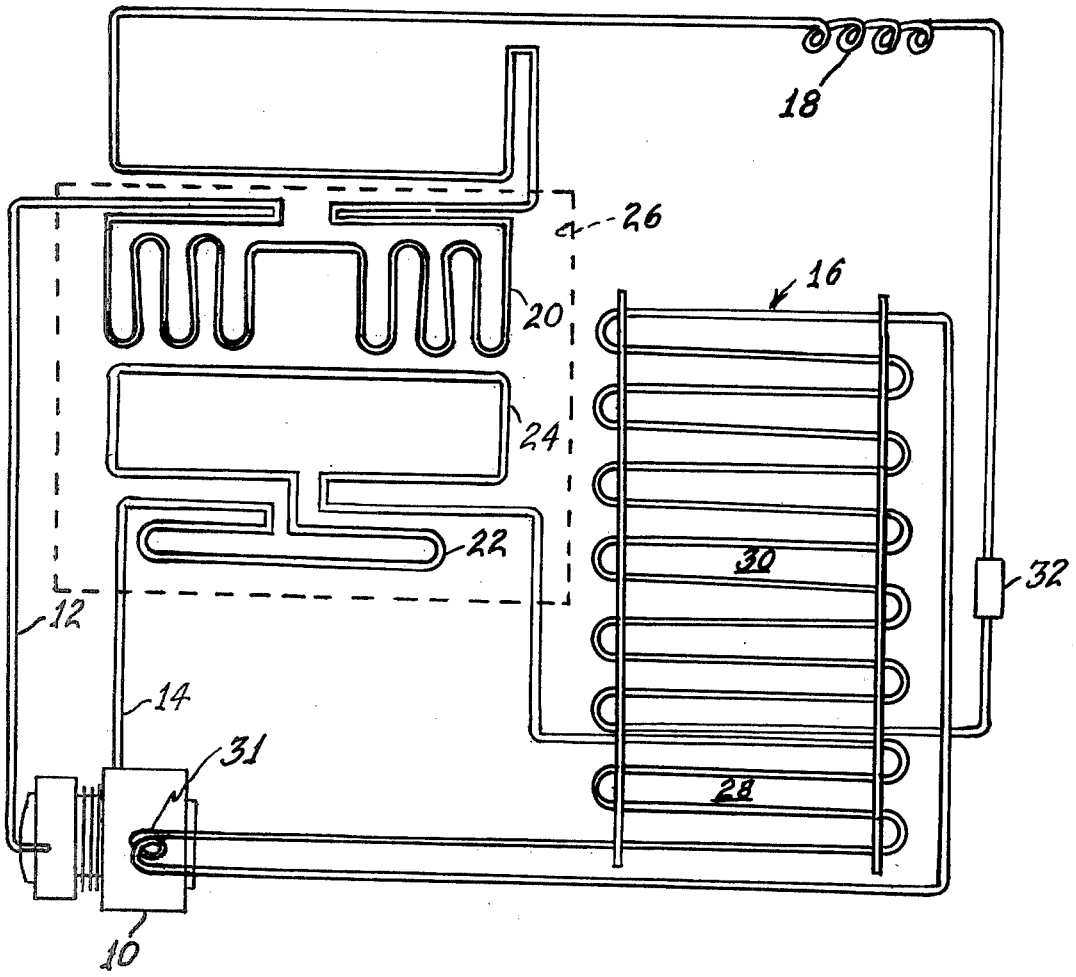
FIG. 1 is a schematic representation of a refrigeration system incorporating the defrosting arrangement of the invention.

Referring to FIG. 1 of the drawings showing a refrigeration system incorporating the defrosting arrangement of the invention, reference character 10 designates a compressor which receives refrigerant as a vapor at low pressure from a suction line 12 and discharges liquid refrigerant at high pressure and temperature into a discharge line 14. The refrigerant is caused to flow through a condenser 16, an expanding device 18 and evaporator 20 as in conventional refrigeration systems. However, in accordance with the invention high pressure, high temperature liquid refrigerant is caused to flow through a first heat transfer loop 22 and preferably also through a second heat transfer loop 24 before entering the condenser 16. As shown, the loop 22 is connected directly to the discharge line 14 and the second loop 24 is connected in series with the first loop. The loop 22 is disposed in a refrigerator freezer compartment 26 as hereinafter described to prevent the accumulation of frost on evaporator 20. The loop 24 may be advantageously employed around the freezer door to prevent the accumulation of frost and moisture at that location.

High pressure, high temperature liquid refrigerant after flowing through the loops 22 and 24 flows into the lower portion 28 of condenser 16 and then into an oil cooler line 31 within the housing of compressor 10. The refrigerant flows from the oil cooler line into and through the upper section 30 of the condenser where it condenses to a high pressure liquid and then flows through a filter strainer 32 to expanding device 18. The high pressure liquid is converted in the expanding device to a low pressure liquid and the low pressure liquid is caused to circulate through the evaporator after which it passes into suction line 12 and then to compressor 10.

The heat transer loop 22 is disposed in refrigeration freezer compartment 26 to contact the evaporator tubing where frost has the greatest tendency to accumulate, that is at inlet end portion 34 extending to the evaporator coils 36 and preferable also at discharge end portion 38 communicating with the exit end of coils 36, in the manner shown, for example, in FIGS. 2 and 3 of the drawings. With the loop so disposed it is effective, due to the high temperature at which it is maintained by the hot refrigerant continuously circulated through it to prevent the accumulation of any substantial amount of frost on the contacted portions of the evaporator as well as on the coils 36. The loop 22 by minimizing the accumulation of frost on the evaporator serves to maintain lower head pressure in the refrigeration system of which it is a part than would otherwise result and power is thereby conserved, this being due to the fact that heat transfer surfaces devoid of frost operate at a better overall heat transfer coefficient.

The preferred embodiment of the invention having been shown and described it is to be understood that other embodiments are possible and that various other changes and modifications may be made in the arrangement disclosed by one skilled in the art without departing from the spirit and scope of the invention as set forth in the annexed claims.

We claim:

1. In a refrigeration system including a compressor; a compressor discharge line; a compressor suction line; a condenser; a refrigerant expanding device; and an evaporator; the evaporator being located in a refrigerator compartment, and the condenser, the expanding device and the evaporator being connected in series between said discharge and suction lines in positions wherein the expanding device is upstream with respect to the flow of refrigerant from the evaporator and the condenser is upstream from the expanding device; a heat transfer loop connected between and in series with said discharge line and the condenser to continuously receive hot liquid refrigerant from the compressor during the operation thereof, the loop being disposed in said compartment in contact with evaporator tubing to minimize the accumulation of frost at the evaporator.

2. The combination of claim 1 wherein said heat transfer loop contacts at least an inlet end portion of the evaporator tubing.

3. The combination of claim 1 wherein said heat transfer loop contacts both an inlet end portion and discharge end portion of the evaporator tubing.

4. The combination of claim 1 including another heat transfer loop located between the said discharge line and condenser in series with the first mentioned loop, such another loop being deployed in said refrigerator compartment to minimize frost accumulation and moisture condensation at a selected location.

5. The combination of claim 4 wherein the said another loop is located downstream from the loop in contact with the evaporator tubing.

6. In a refrigerant carrying circuit including a compressor; a compressor discharge line; a compressor suction line; a condenser; a refrigerant expanding device; and an evaporator; the condenser, expanding device and evaporator being connected in series between said discharge and suction lines in positions wherein the expanding device is upstream with respect to the flow of refrigerant from the evaporator and the condenser is upstream from the expanding device; a heat transfer loop connected between and in series with said discharge line and the condenser to continuously receive hot liquid refrigerant from the compressor during the operation thereof, the loop being disposed in contact with evaporator tubing to minimize the accumulation of frost at the evaporator.

* * * * *